US012286197B2

(12) United States Patent
Steed et al.

(10) Patent No.: US 12,286,197 B2
(45) Date of Patent: Apr. 29, 2025

(54) VENTURI EFFECT SCUPPER DRAIN

(71) Applicant: Lifetime Products, Inc., Clearfield, UT (US)

(72) Inventors: Brent Steed, Syracuse, UT (US); Edward G. Van Nimwegen, Ogden, UT (US)

(73) Assignee: Lifetime Products, Inc., Clearfield, UT (US)

( * ) Notice: Subject to any disclaimer, the term of this patent is extended or adjusted under 35 U.S.C. 154(b) by 341 days.

(21) Appl. No.: 17/657,550

(22) Filed: Mar. 31, 2022

(65) Prior Publication Data

US 2022/0340236 A1 Oct. 27, 2022

Related U.S. Application Data

(60) Provisional application No. 63/178,736, filed on Apr. 23, 2021.

(51) Int. Cl.

| | |
|---|---|
| ***B63B 13/00*** | (2006.01) |
| ***B63B 34/21*** | (2020.01) |
| ***B63H 5/00*** | (2006.01) |

(52) U.S. Cl.

CPC ..... *B63B 13/00* (2013.01); *B63B 34/21* (2020.02); *B63H 5/00* (2013.01)

(58) Field of Classification Search

CPC ... B63B 13/00; B63B 13/02; B63B 2013/005; B63B 34/21; B63H 5/00

USPC ..... 114/182, 41

See application file for complete search history.

(56) References Cited

U.S. PATENT DOCUMENTS

| | | | | |
|---|---|---|---|---|
| 2,138,368 | A | 11/1938 | Briant | |
| 3,911,848 | A | 10/1975 | Brazier | |
| 4,787,328 | A | 11/1988 | Inoue | |
| 2014/0196655 | A1 * | 7/2014 | Jansen | B63H 5/16 114/290 |
| 2020/0307747 | A1 | 10/2020 | Schmidt | |

FOREIGN PATENT DOCUMENTS

AU 2010214681 A1 3/2011

OTHER PUBLICATIONS

International Search Report and Written Opinion for PCT/US2022/071579, mailed Aug. 3, 2022.

* cited by examiner

*Primary Examiner* — Daniel V Venne
(74) *Attorney, Agent, or Firm* — Workman Nydegger

(57) ABSTRACT

An example watercraft includes a hull that defines a cockpit. A scupper is provided that extends from the cockpit through an exterior surface of the hull. A recess defined by the hull is in communication with the scupper, and the recess defines a portion of a venturi tube. A plate that is attachable to the hull is configured to define another portion of the venturi tube such that when the plate is attached to the hull, a complete venturi tube is defined.

20 Claims, 21 Drawing Sheets

VENTURI EFFECT SCUPPER DRAIN

FIELD OF THE INVENTION

Example embodiments of the invention generally relate to watercraft, examples of which include, but are not limited to, kayaks, canoes, row boats, rowing shells, paddleboats, and any other human-powered watercraft, suitable for use in water sports or other activities. At least one example embodiment embraces a watercraft that includes a scupper which may be drained by way of a venturi as the watercraft moves through the water. Embodiments may be employed in human-powered watercraft, as well as in motorized watercraft.

BACKGROUND

Typical self-bailing watercraft, such as kayaks for example, are configured so that water that comes into the cockpit will drain out of the cockpit, through one or more scuppers, until the water level in the cockpit reaches the same level as the water-line outside the kayak. As long as the floor of the cockpit is higher than the water-line outside the kayak, the water on the floor of the cockpit will drain out of the cockpit into the scuppers below the floor level. This process may be ongoing as long as water continues to enter the cockpit.

ASPECTS OF SOME EXAMPLE EMBODIMENTS

Some example embodiments are concerned with a watercraft that may comprise one or more features. One example feature comprises one or more scuppers that may be positioned at various locations in the cockpit of the watercraft. Because the scuppers may be respectively located at relatively low points or areas in the cockpit, water entering the cockpit may run to, and be collected by, the scuppers. In this way, the scuppers may help to keep water from pooling in the bottom of the watercraft. As such, at least some embodiments of the watercraft may be referred to as having a self-bailing cockpit. One or more scuppers may, or may not, have a flap, or comparable device, that enables water to flow from a portion of the watercraft cockpit into the scupper, but prevents water from entering the scupper from outside of the watercraft. Thus, the flap may allow flow in one direction through the scupper, but not in the opposite direction. That is, the flap may serve as a check valve.

In some circumstances, such as rainfall or rough water for example, a significant amount of water may come into the watercraft in a short period of time, and this inflow of water may tax the ability of the scuppers to quickly remove the water from the cockpit. Thus, example embodiments of a watercraft may comprise a venturi tube that is in fluid communication with the discharge side of a scupper. In general, the venturi tube may operate to drain the scupper more quickly than would be the case if the venturi tube were not present.

Note that in the context of embodiments of the invention, the venturi tube may be referred to herein simply as a 'venturi.' Thus, in some embodiments, the venturi may be completely submerged during normal operation of the watercraft. As the watercraft moves through the water, fluid flow through the venturi may create a low pressure zone in the venturi. A pressure differential collectively defined by the low pressure zone of the venturi and the interior of the scupper may cause water to flow from the area of relatively higher pressure, that is, the interior of the scupper, to the area of relatively lower pressure, that is, the low pressure zone of the venturi. This water that enters the venturi from the scupper due to the pressure differential may then flow out of the venturi as a result of movement of the watercraft through the water. The pressure differential may also be referred to herein as a vacuum.

It is noted that the embodiments disclosed herein do not constitute an exhaustive summary of all possible embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure.

As well, none of the embodiments embraced within the scope of this disclosure should be construed as resolving, or being limited to the resolution of, any particular problem(s). Nor should such embodiments be construed to implement, or be limited to implementation of, any particular effect(s).

BRIEF DESCRIPTION OF THE DRAWINGS

The appended drawings contain figures of various example embodiments to further illustrate and clarify the above and other aspects of example embodiments of the present invention. It will be appreciated that these drawings depict only example embodiments of the invention and are not intended to limit its scope. The invention will be described and explained with additional specificity and detail through the use of the accompanying drawings.

DETAILED DESCRIPTION OF SOME EXAMPLE EMBODIMENTS

Figure 1:
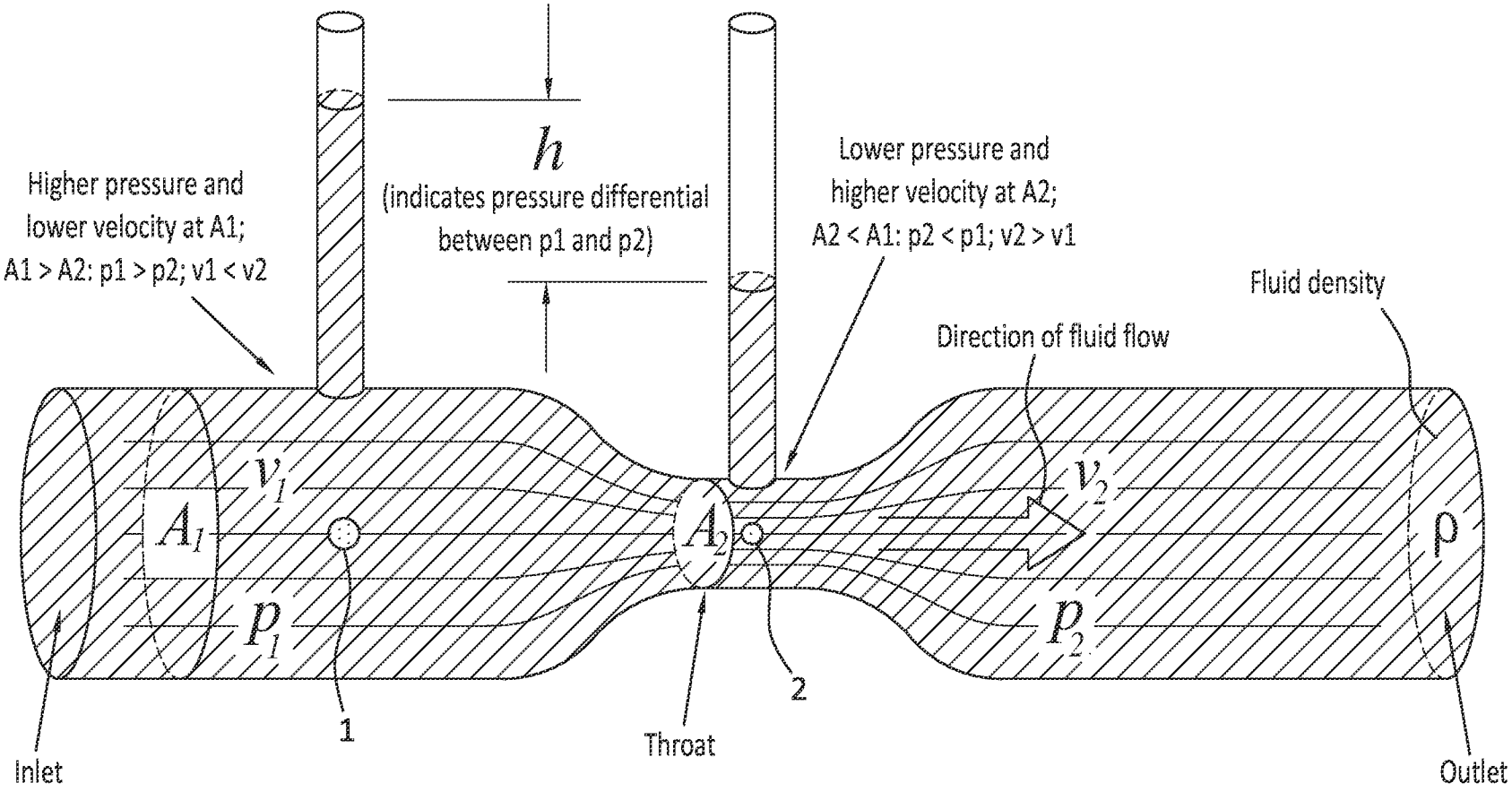
FIG. 1 discloses a stylized venturi configuration and related information concerning properties of a venturi.

With reference now to the figures, details are provided concerning aspects of example embodiments of the invention. Such embodiments may comprise, or be employed with, a variety of different watercraft, examples of which include, but are not limited to, kayaks such as sit-inside kayaks and sit-on-top kayaks, canoes, row boats, rowing shells, paddleboats, and any other human-powered watercraft, suitable for use in water sports or other activities. Embodiments of the invention may further comprise, or be employed with, motorized watercraft.

Embodiments of the invention, such as the examples disclosed herein, may be beneficial in a variety of respects. For example, and as will be apparent from the present disclosure, one or more embodiments of the invention may provide one or more advantageous and unexpected effects, in any combination, some examples of which are set forth below. It should be noted that such effects are neither intended, nor should be construed, to limit the scope of the claimed invention in any way. It should further be noted that nothing herein should be construed as constituting an essential or indispensable element of any invention or embodiment. Rather, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should any such embodiments be construed to implement, or be limited to implementation of, any particular technical effect(s) or solution(s). Finally, it is not required that any embodiment implement any of the advantageous and unexpected effects disclosed herein.

In particular, some example embodiments may enable relatively more rapid draining of a cockpit of a watercraft due to a pressure differential imposed at the scupper outlet. The pressure differential is created by the movement of water through the venturi that is connected to the scupper outlet. So long as the watercraft is moving through the water, the water may tend to drain more quickly from the cockpit than would be the case if no venturi were present.

As another example, the pressure differential achieved in example embodiments, through use of the venturi, may enable the water level inside the watercraft to be drawn down to a level that is below the waterline of the watercraft. Correspondingly, embodiments may thus include a cockpit floor that is positioned lower in the watercraft than in conventional watercraft that do not employ a venturi. The relatively lower position of the cockpit floor that may be achieved in some embodiments may, in turn, provide various further advantages.

For example, the watercraft may be made more stable by lowering the seat and the floor which, in turn, results in a lower seating position for the user, creating a lower overall center of gravity that facilitates improved stability. In other embodiments, the seat position may be maintained, but the floor may be lowered, which may create a more comfortable seating position for the user. Various other advantages of example embodiments of the invention will be apparent from this disclosure.

A. GENERAL ASPECTS OF SOME EXAMPLE EMBODIMENTS

In general, the watercraft and components disclosed herein may be constructed with a variety of elements and materials including, but not limited to, plastic (including blow molded plastic structures and elements) such as high density polyethylene (HDPE), including polycarbonates, composites, metals, and combinations of any of the foregoing. Suitable metals may include steel, stainless steel, aluminum, aluminum alloys, bronze, nickel, copper, copper-nickel alloys, and brass, although the skilled person will understand that a variety of other metals may be employed as well and the scope of the invention is not limited to the foregoing examples. Where metal is employed in the construction of a component, the metal elements may take one or more forms including, but not limited to, pipe, square tube, rectangular tube, round tube, angles, flat bar, I-shapes, T-shapes, L-shapes, and combinations and portions of any of the foregoing.

Depending upon the material(s) employed in the construction of one or more embodiments, a variety of methods and components may be used to connect, releasably or permanently, various elements of one or more embodiments. For example, the various elements of components within the scope of this disclosure may be attached to each other by any one or more of allied processes such as welding or brazing, soldering, and/or mechanically by way of fasteners such as bolts, screws, pins, and rivets, for example.

Some, none, or all of portions of a one or more of the disclosed components may be coated or otherwise covered with paint, rubber, plastic or other materials, or any combination of the foregoing. Surface treatments and textures may also be applied to elements of the disclosed embodiments. At least some of such materials may serve to help prevent, or reduce, rust and corrosion. Various other materials that may be employed in one or more components and elements are disclosed elsewhere herein.

Where plastic, such as HDPE for example, is employed in the construction of a watercraft, the watercraft may take the form of an integral plastic blow-molded structure of a unified, single-piece construction. The interior of the watercraft may be hollow in such embodiments. In other embodiments, a watercraft may be constructed using processes such as injection molding, stretch blow molding, rotomolding, or twin sheet molding, for example. No particular production process is required for any embodiment however.

Finally, any embodiment of a kayak or other watercraft that includes a hull which is constructed at least partly of blow-molded, or otherwise formed, plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the hull, towards a second surface, such as a second interior surface of the hull. The ends of one or more depressions may contact or engage the second surface, or the ends of one or more of the depressions may be spaced apart from the second surface by a distance. In some instances, one or more depressions a on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depressions that contact each other and depressions that are spaced apart from each other may both be present in a kayak or other watercraft. The depressions may be sized and configured to strengthen and/or reinforce the blow-molded plastic hull of the kayak or other watercraft. Finally, the depression, or depressions, can be any shape or size, and depressions of different respective shapes and/or sizes can be combined in a single watercraft.

B. ASPECTS OF AN EXAMPLE WATERCRAFT

B.1 Watercraft Configuration

Figure 2:
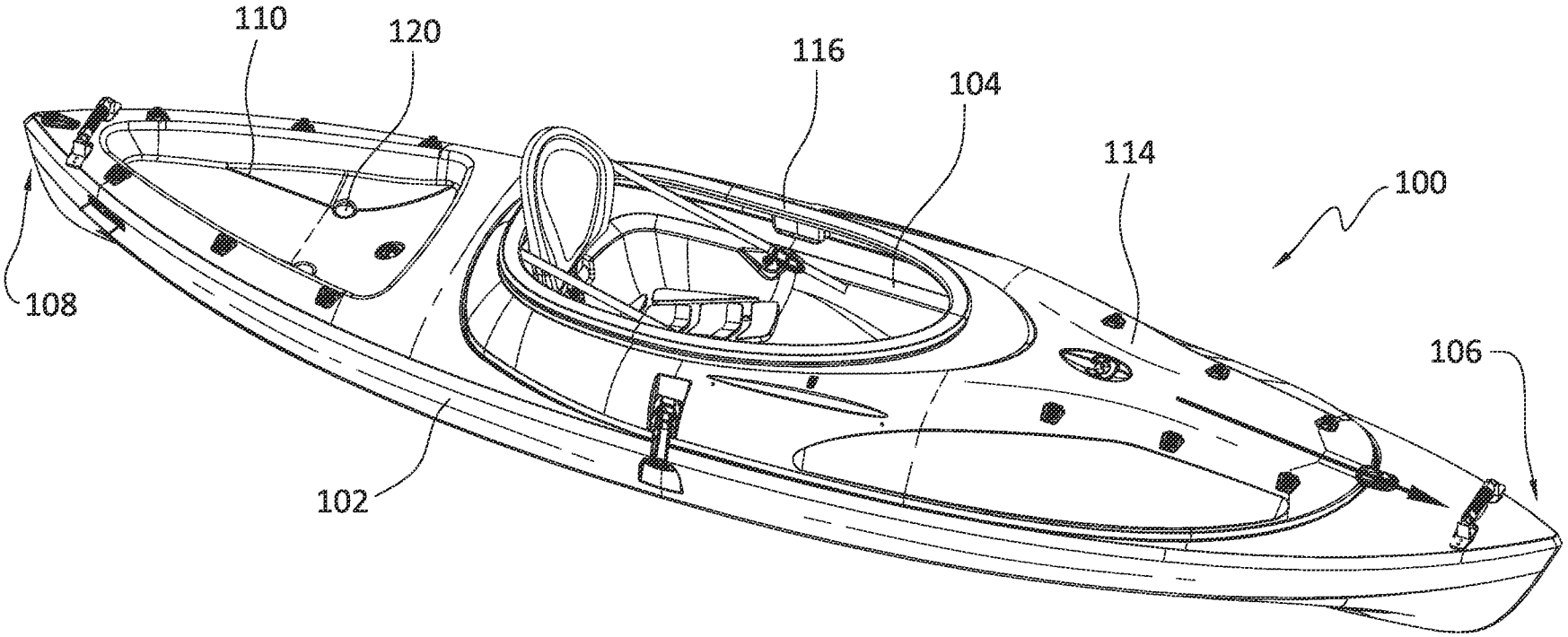
FIG. 2 is a top perspective view of an example watercraft according to some embodiments.
Figure 3:
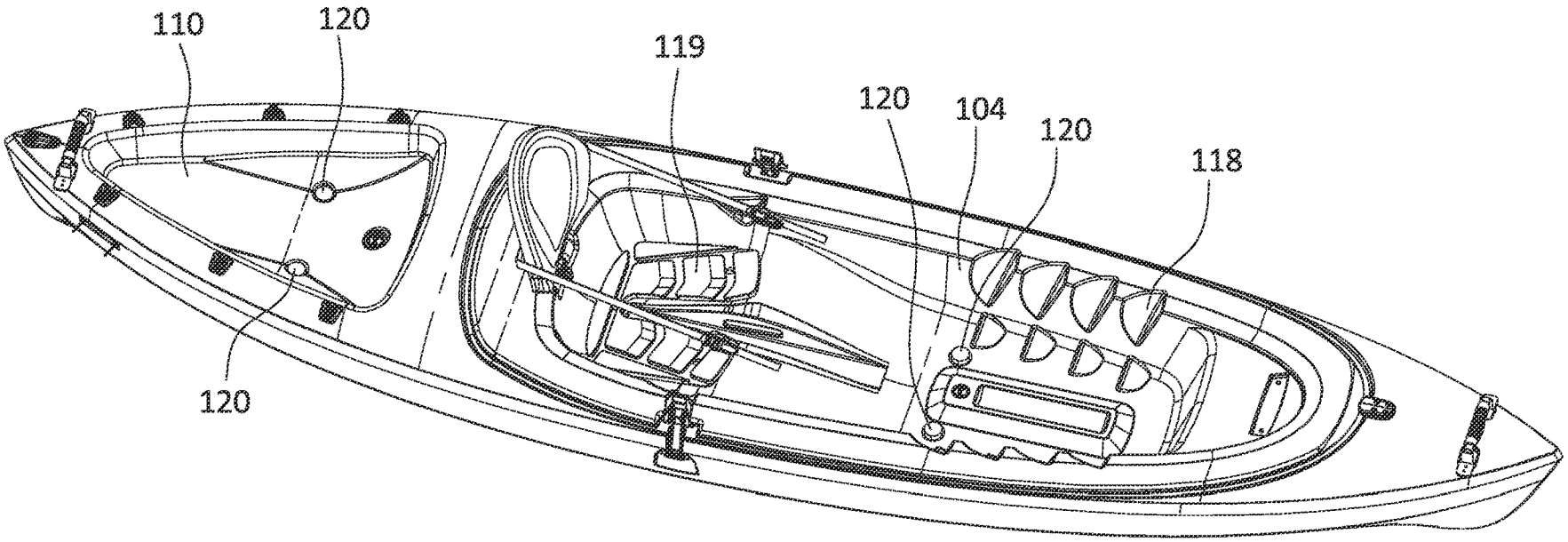
FIG. 3 is a top perspective view of another example watercraft according to some embodiments.
Figure 4:
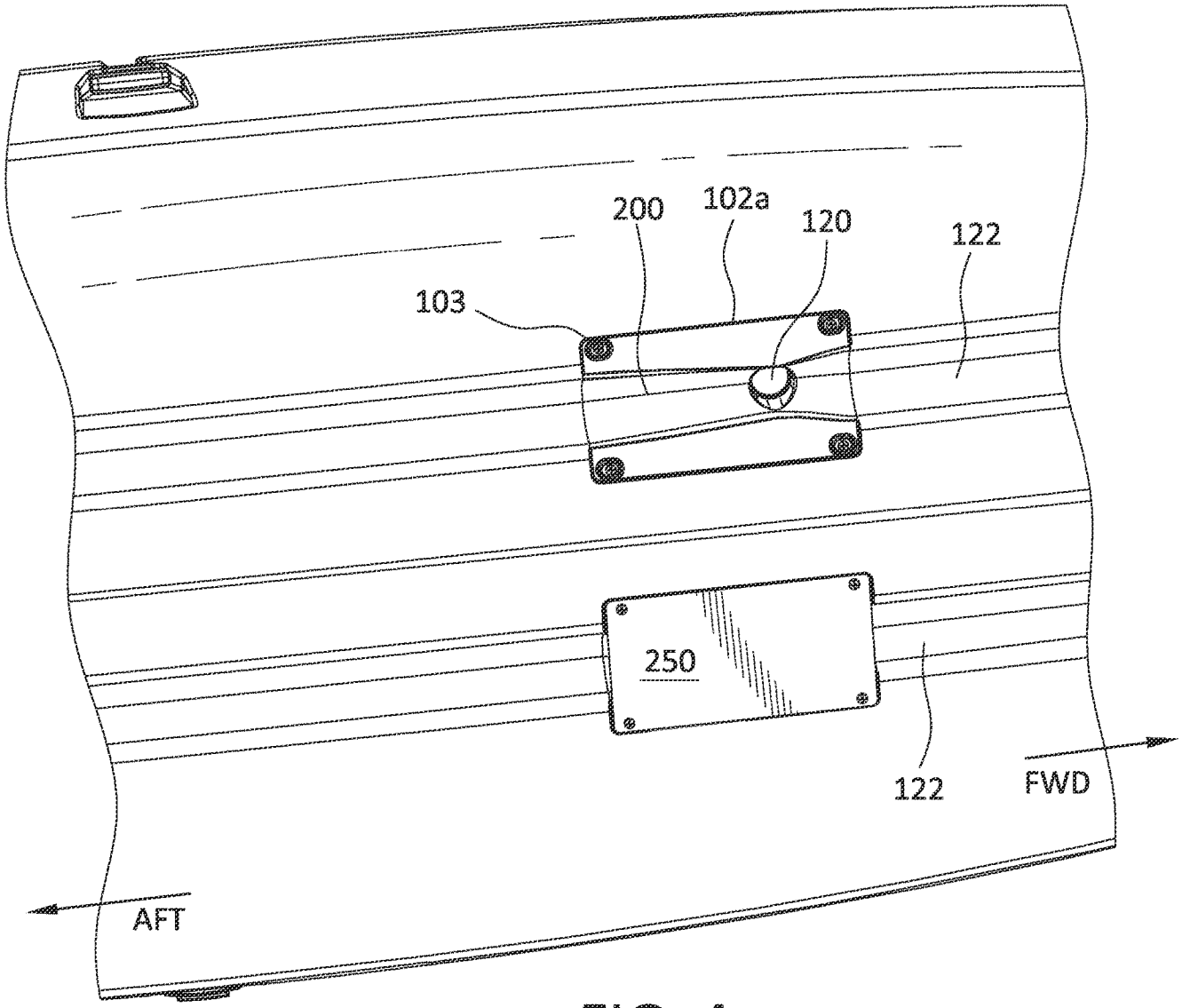
FIG. 4 is a partial bottom view of an example watercraft that includes a venturi and venturi plate, according to some embodiments.

With reference now to FIG. 1, FIG. 2, FIG. 3, FIG. 4, FIG. 5, FIG. 6, FIG. 7, FIG. 8, FIG. 9, FIG. 10, FIG. 11, FIG. 12, FIG. 13, FIG. 14, FIG. 15, FIG. 16, FIG. 17, FIG. 18, FIG. 19, and FIG. 20, details are provided concerning various aspects of example embodiments of the invention. As shown in FIGS. 2 and 3 for example, an embodiment of the invention may comprise a watercraft 100 such as, for example, a sit inside kayak or sit on top kayak. Other types of watercraft that may be employed in some embodiments are disclosed elsewhere herein. Embodiments may be implemented in motorized watercraft, or in human-powered watercraft. The example watercraft 100 includes a hull 102. The hull 102 may be an integral plastic blow-molded structure of a unified, single-piece construction. In other embodiments, the hull 102 may be constructed using processes such as injection molding, stretch blow molding, rotomolding, or twin sheet molding. The example watercraft 100 may comprise a variety of different components.

The hull 102 may define a cockpit 104, as well as a bow 106 and stern 108 of the watercraft. The hull 102 may also define a recessed portion 110 that may serve as a storage area, and one or more scuppers 120 may be configured and arranged to drain the recessed portion 110. In some embodiments, the scuppers 120 may be provided with scupper plugs, but that is not required.

In some embodiments of the watercraft 100, a removable cover 114 may be provided that encloses a forward portion of the cockpit 104. The removable cover 114 may be used, for example, when rough or stormy weather is expected and, as such, may help to limit the amount of water that enters the cockpit 104, and the removable cover 114 may also help to keep the user relatively dry during rough and/or rainy conditions. As well, the removable cover 114 may define an opening 116 by way of which the user may enter and exit the watercraft 100.

As indicated in FIG. 3, one or more foot rests 118 may be defined on either side of the cockpit 104, and one or more seats 119 provided in the cockpit 104. The cockpit 104 may be drained by one or more scuppers 120, one or more of which may be located at a low point of the cockpit, as also shown in FIG. 3. One or more of the scuppers 120 may, or may not, include respective plugs or covers. In general, and as discussed in more detail elsewhere herein, one, some, or all, of the scuppers 120 may be configured and arranged for fluid communication with a respective venturi 200 configured and arranged to drain the scupper 120 with which it is connected.

As is the case with all of the other elements of the watercraft 100, the scuppers 120 may be integrally formed together with the hull 102 during a single molding process, such as a blow-molding process for example. As such, the scuppers 120 and the hull 102 may together form an integral portion of a unified, single-piece, structure.

Figure 5:
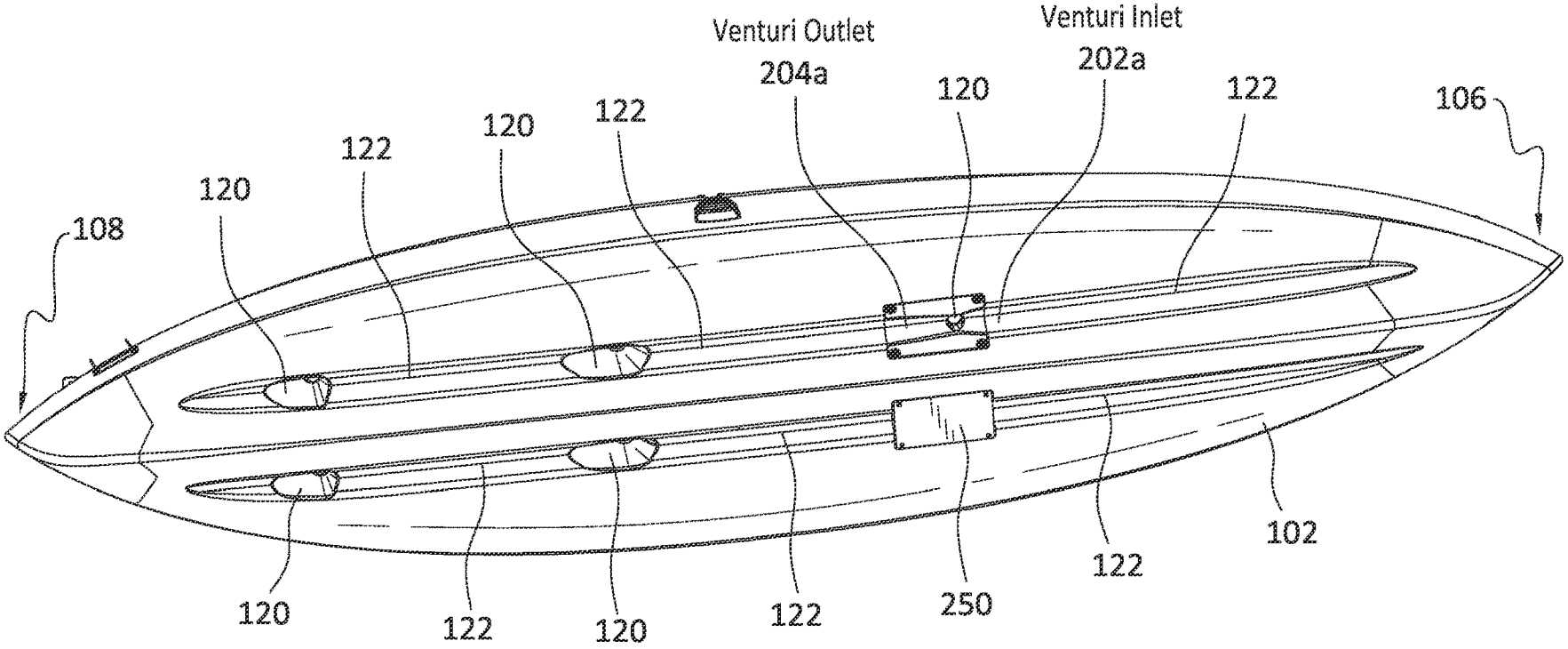
FIG. 5 is a bottom view of an example watercraft, indicating example scupper and venturi plate locations, according to some embodiments.
Figure 6:
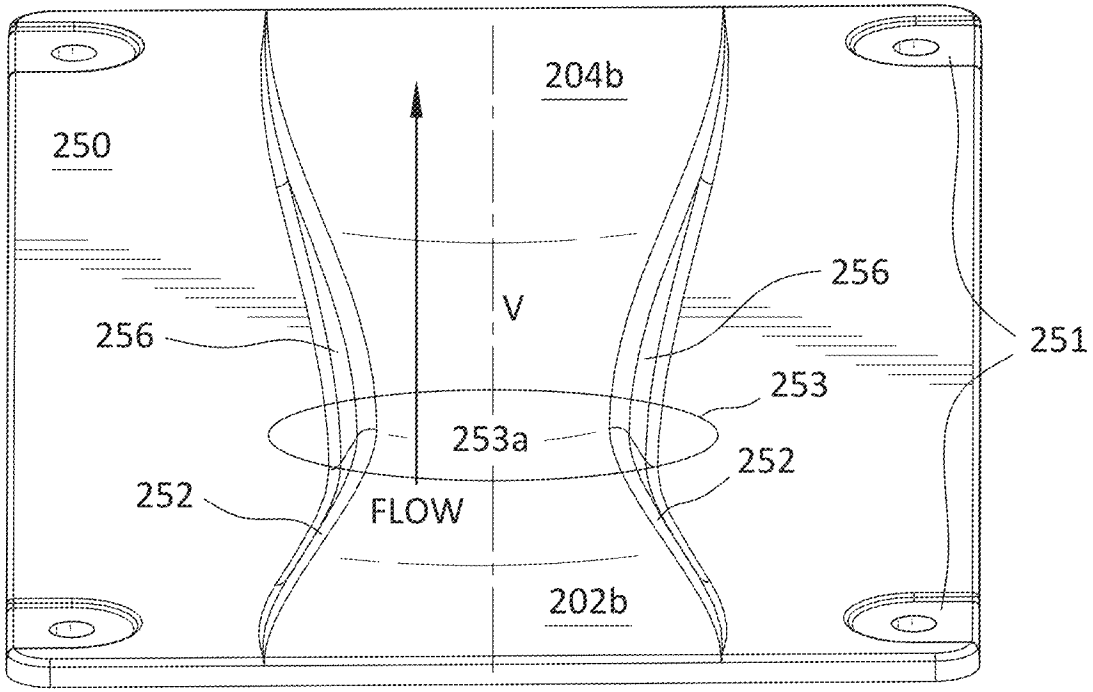
FIG. 6 is a top perspective view of an example venturi plate, looking aft, according to some embodiments.
Figure 7:
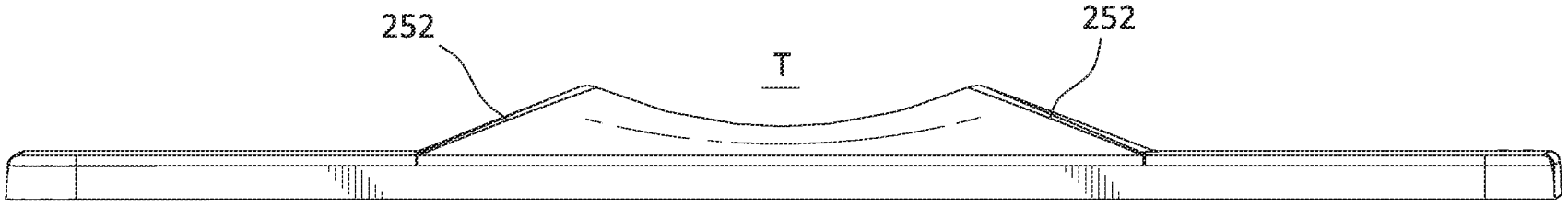
FIG. 7 is a front view of an example venturi plate, looking aft, according to some embodiments.
Figure 8:
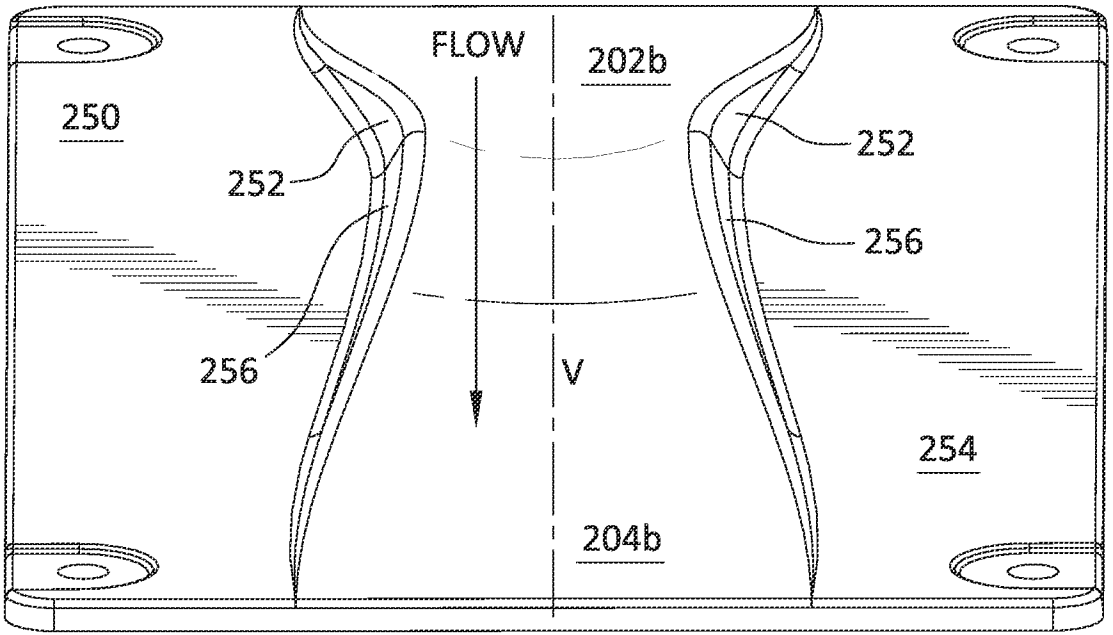
FIG. 8 is a top perspective view of an example venturi plate, looking forward, according to some embodiments.
Figure 9:
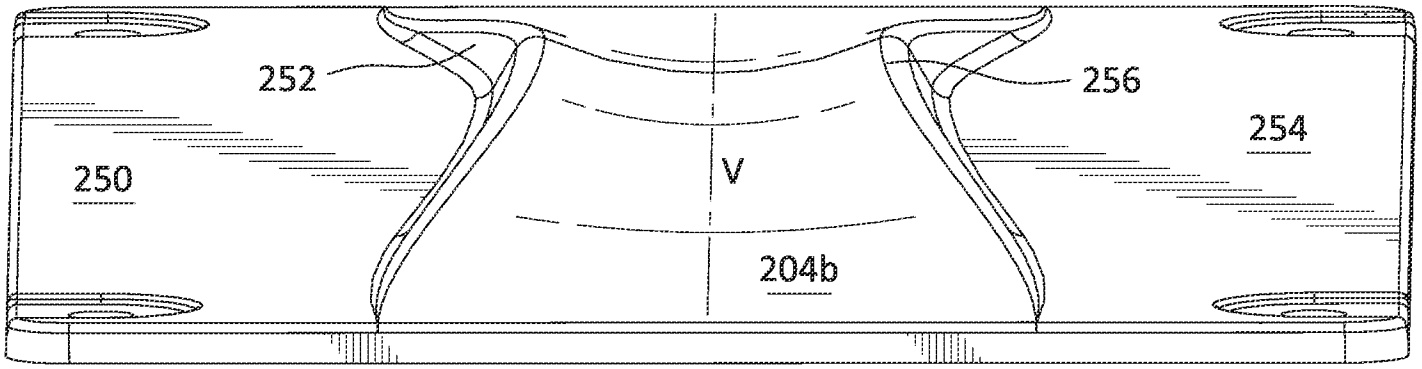
FIG. 9 is another top perspective view of an example venturi plate, looking forward, according to some embodiments.

With particular reference to FIG. 5, the hull 102 may comprise, on its underside, one or more recesses 122 that may run a majority of a length of the watercraft. In general, and except as noted herein, the recesses 122 may each have a generally uniform width, depth, and cross-sectional shape except near the bow 106 and/or stern 108 of the watercraft. In the area where a venturi 200 (see, e.g., FIG. 4) is located, the width and/or depth of a recess 122 may vary along a length of the recess 122, as may be best shown in the plan view of FIG. 13.

Like the scuppers 120, the recesses 122 may be integrally formed together with the hull 102 during a single molding process, such as a blow-molding process for example. As such, the recesses 122 and the hull 102, as well as the scuppers 120, may together form an integral portion of a unified, single-piece, structure.

B.2 Venturi Configuration and Arrangement

In general, some example embodiments of the venturi 200 may be jointly defined by a portion of a recess 122 in cooperation with a venturi plate 250 (see, e.g., FIGS. 4, 5, 6, 7, 8, 9, 10, 11, 12, 13, and 14), which may be blow-molded or injection molded for example, that may be permanently, or removably, connected to the hull 102. That is, the recess 122 and venturi plate 250 each define respective portions, such as halves or other fractional portions for example, of the venturi 200 such that when the venturi plate 250 is attached to the hull 102, the complete venturi 200 is thereby formed. In the illustrated examples, the recess 122 and venturi plate 250 are configured such that the recess 122 defines an upper portion of the venturi 200 and the venturi plate 250 defines a lower portion of the venturi 200, although other configurations and arrangements of the recess 122 and venturi plate 250 may be employed in alternative embodiments. In some embodiments, a gasket or other seal (not shown) may be positioned between the venturi plate 250 and the hull 102 so as to seal the venturi plate 250 to the hull 102. Finally, in some embodiments, a separate venturi plate 250 may be omitted and the venturi 200 may be entirely defined by, and integral with, the structure of the watercraft 100.

In some embodiments, a venturi 200 may be located in the forward half, or forward ⅔, of the watercraft 100, but no particular location of the venturi 200 is required. The venturi 200 may be arranged so that a longitudinal axis of the venturi 200 is generally oriented fore-and-aft, parallel to a longitudinal centerline CL (see FIG. 2) of the watercraft 100, or within about a 10 degree to about 15 degree offset, to port or starboard and/or above/below horizontal, from the longitudinal centerline of the watercraft 100.

In term of its location and orientation, a venturi 200 may be located anywhere that it is capable of draining a scupper 120 to which it is connected. The venturi 200 may generally be shaped as shown in the example of FIG. 1, and the example of FIG. 13. As shown in FIGS. 5, 13, 18*a*, and 18*b*, the venturi 200 may comprise an inlet 202 that is located upstream, or forward, of an outlet 204. In some embodiments, the inlet 202 may be shorter in length than the outlet 204.

The scope of the invention is not limited to configurations that include only a single venturi 200. Rather, a watercraft may employ any number of venturis 200 such as, for example, up to six venturis 200, or more. In general, a respective venturi 200 may serve each of the one or more scuppers 120 of a watercraft 100, although that is not necessarily required and, in some embodiments, there may be one or more scuppers 120 that are not served by a venturi 200. Where a venturi 200 is not provided for a scupper 120, a recess, such as recess 122, for that scupper 120 may likewise be omitted.

Figure 10:
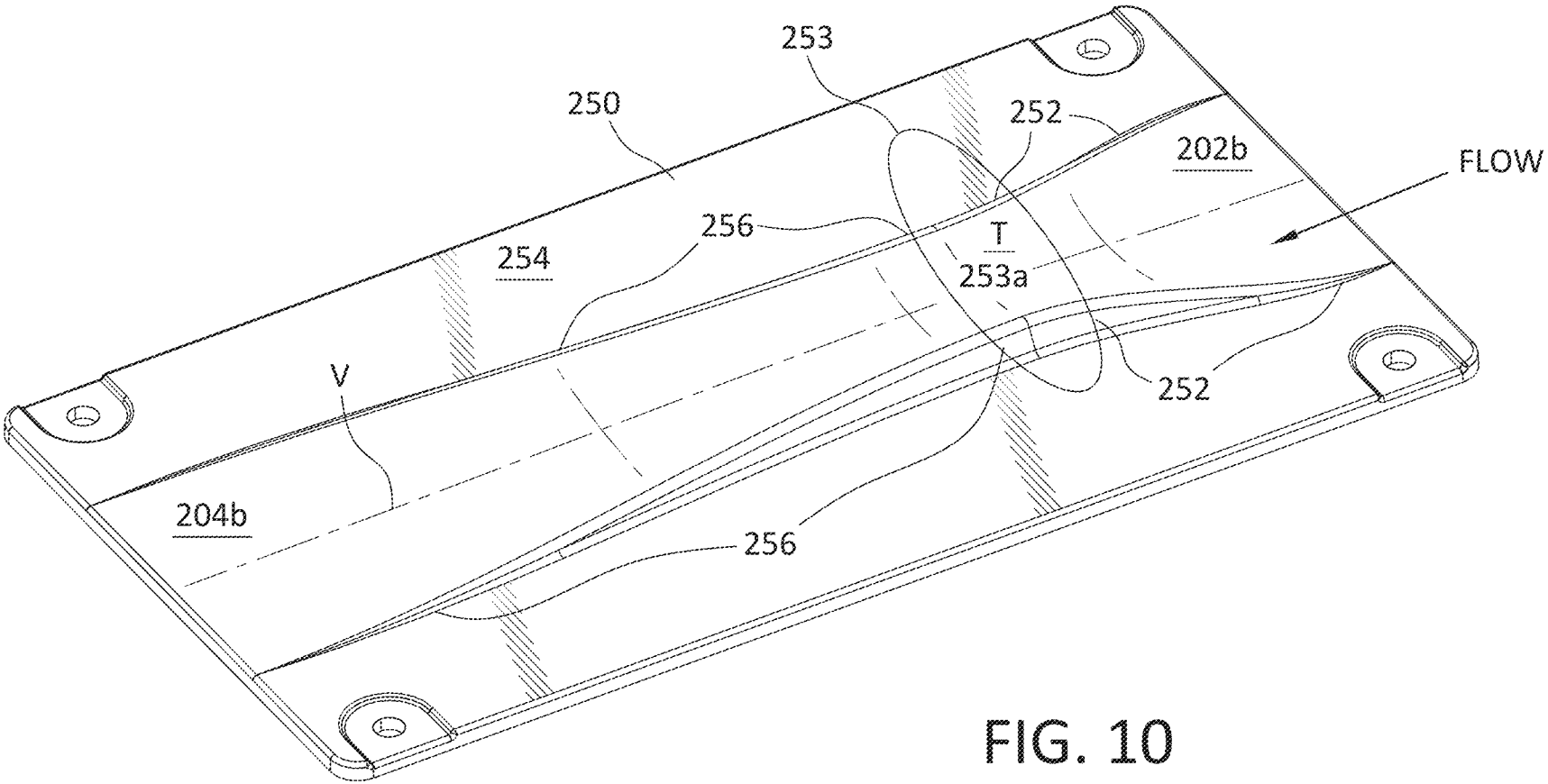
FIG. 10 is a top/side perspective view of an example venturi plate, according to some embodiments.
Figure 11:
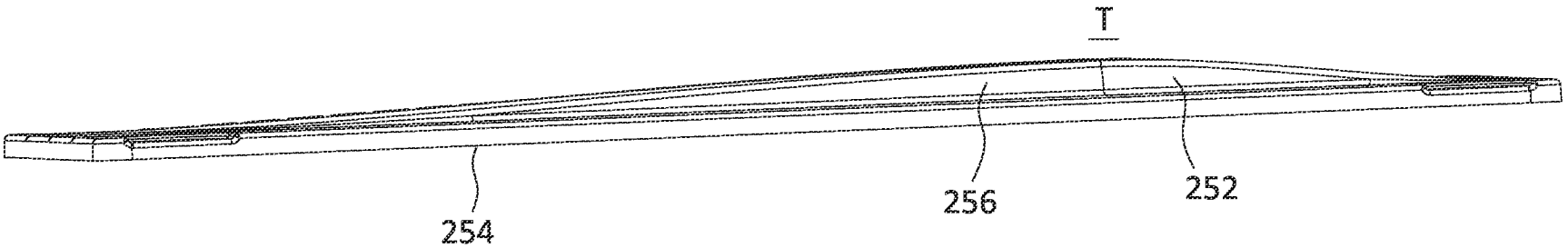
FIG. 11 is a side view of an example venturi plate, according to some embodiments.
Figure 12:
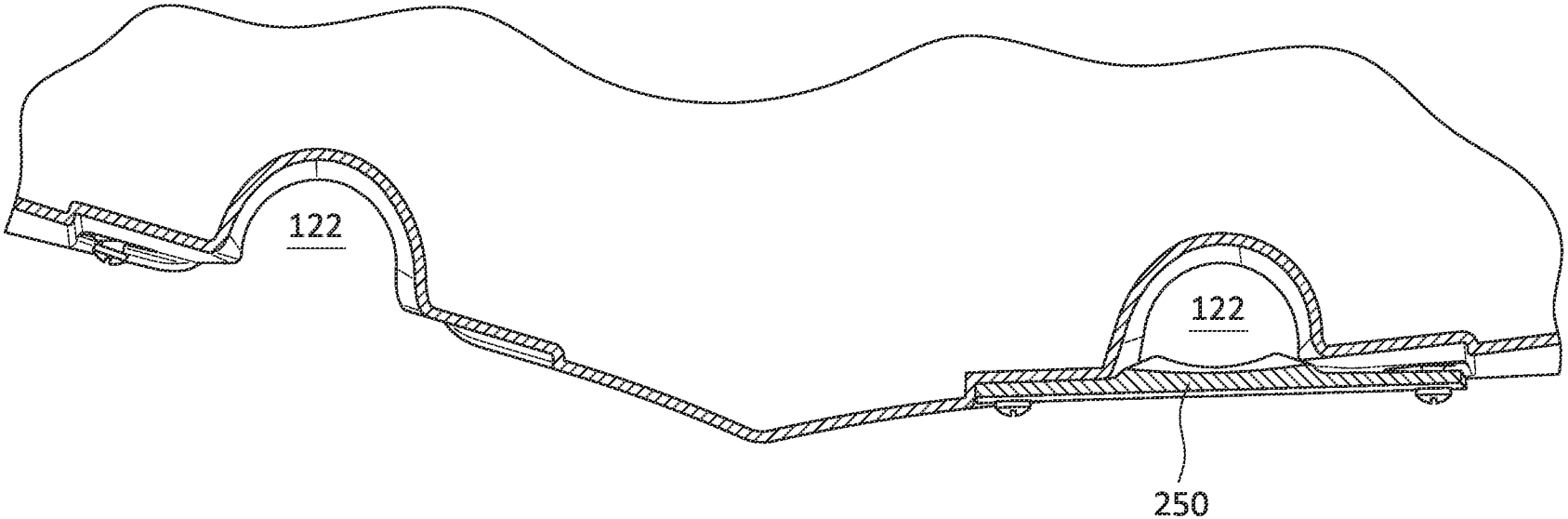
FIG. 12 is a section view of an underside of a watercraft, showing respective hull recesses with/without a venturi plate installed, according to some embodiments.

With continued reference to the Figures, including FIG. 5, the recess 122 may define a venturi inlet portion 202*a* and venturi outlet portion 204*a*. As shown in the example of FIG. 10, the venturi plate 250 may define a corresponding venturi inlet portion 202*b* and venturi outlet portion 204*b*. In general, the venturi inlet portion 202*b* and venturi outlet portion 204*b* are configured and arranged so that when the venturi plate 250 is attached to the hull 102 such as, for example, within a recess 102*a* defined by the hull 102 and held flush to the hull 102 with fasteners 103 which reside within recesses 251 of the venturi plate 250, the venturi plate 250 may thus reside at or below the hull 102 surface. When the venturi plate 250 is thus positioned, the venturi inlet portions 202*a* and 202*b* may be aligned with each other, and venturi outlet portions 204*a* and 204*b* are aligned with each other, resulting in formation of the entire venturi 250.

Figure 13:
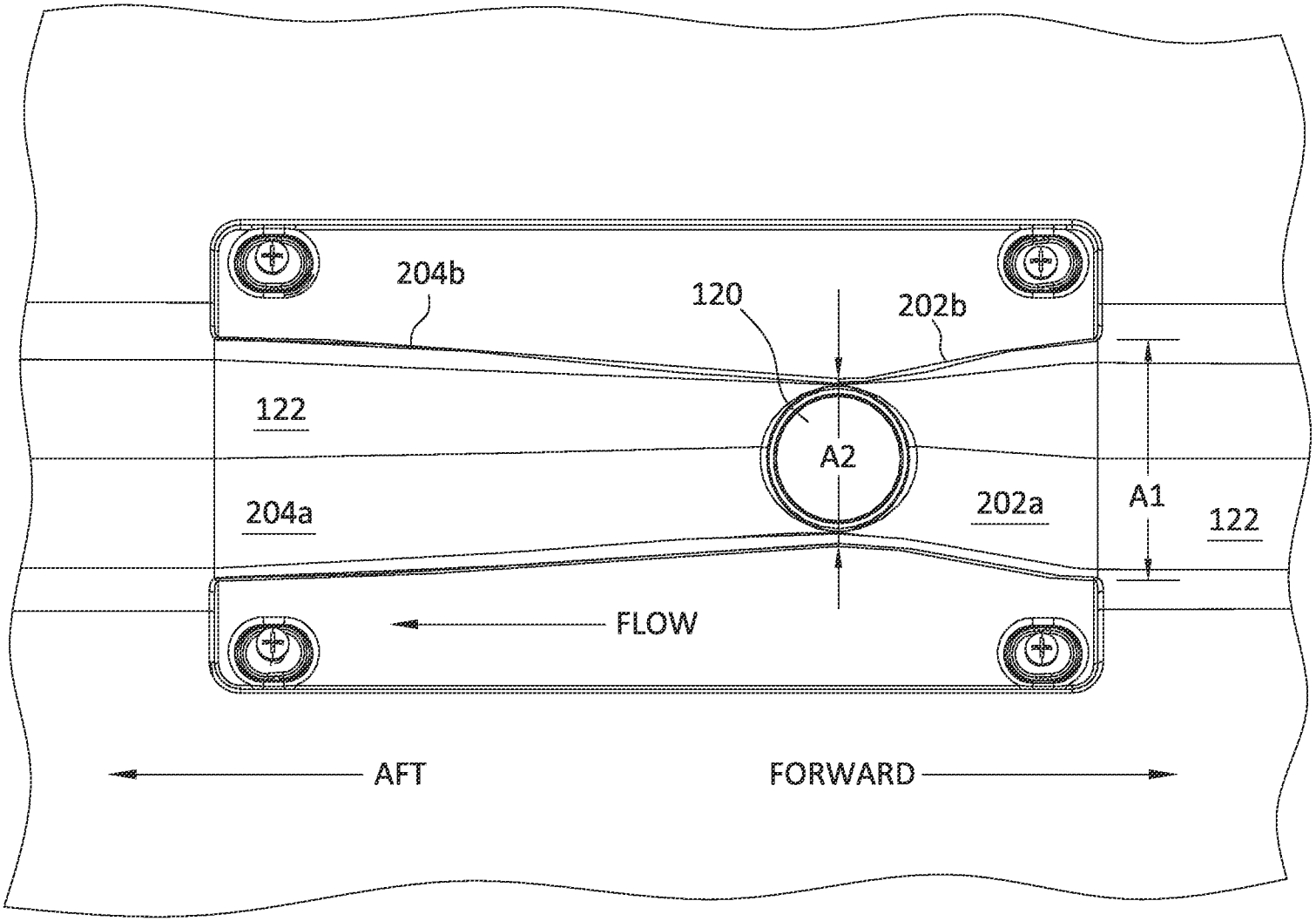
FIG. 13 is a view looking down onto a venturi plate (shown transparent for illustration purposes) and its relation to an example scupper, according to some embodiments.
Figure 14:
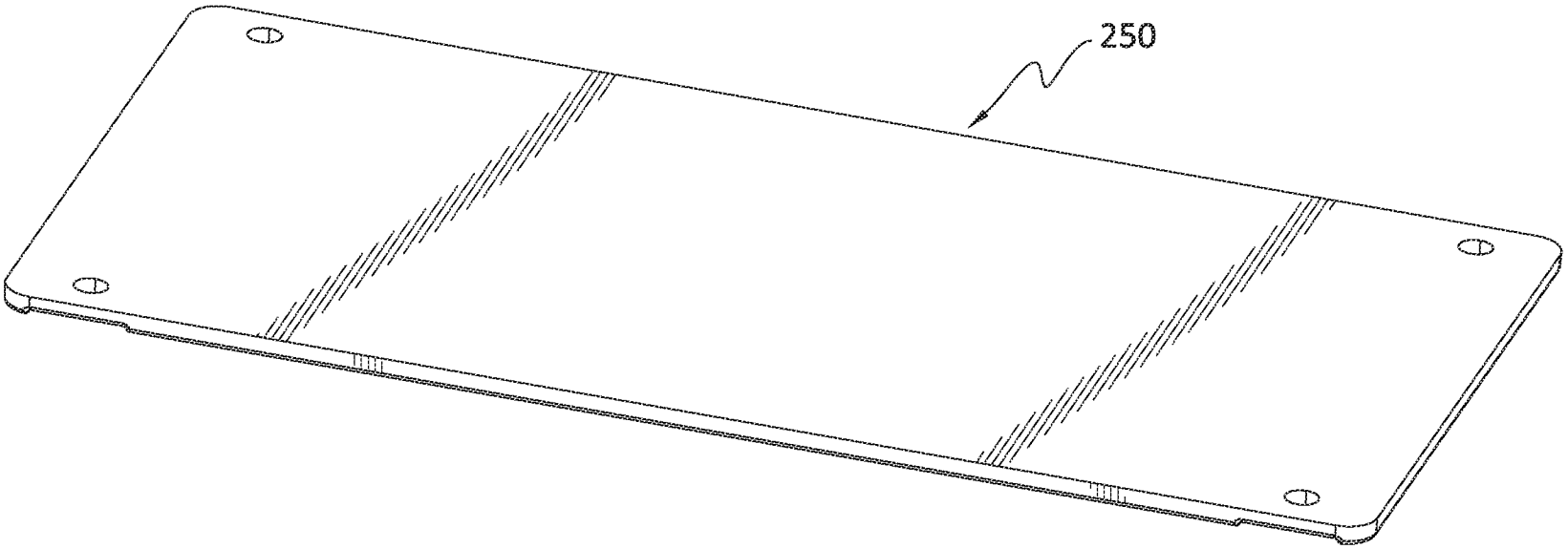
FIG. 14 is a bottom view of a venturi plate.
Figure 15:
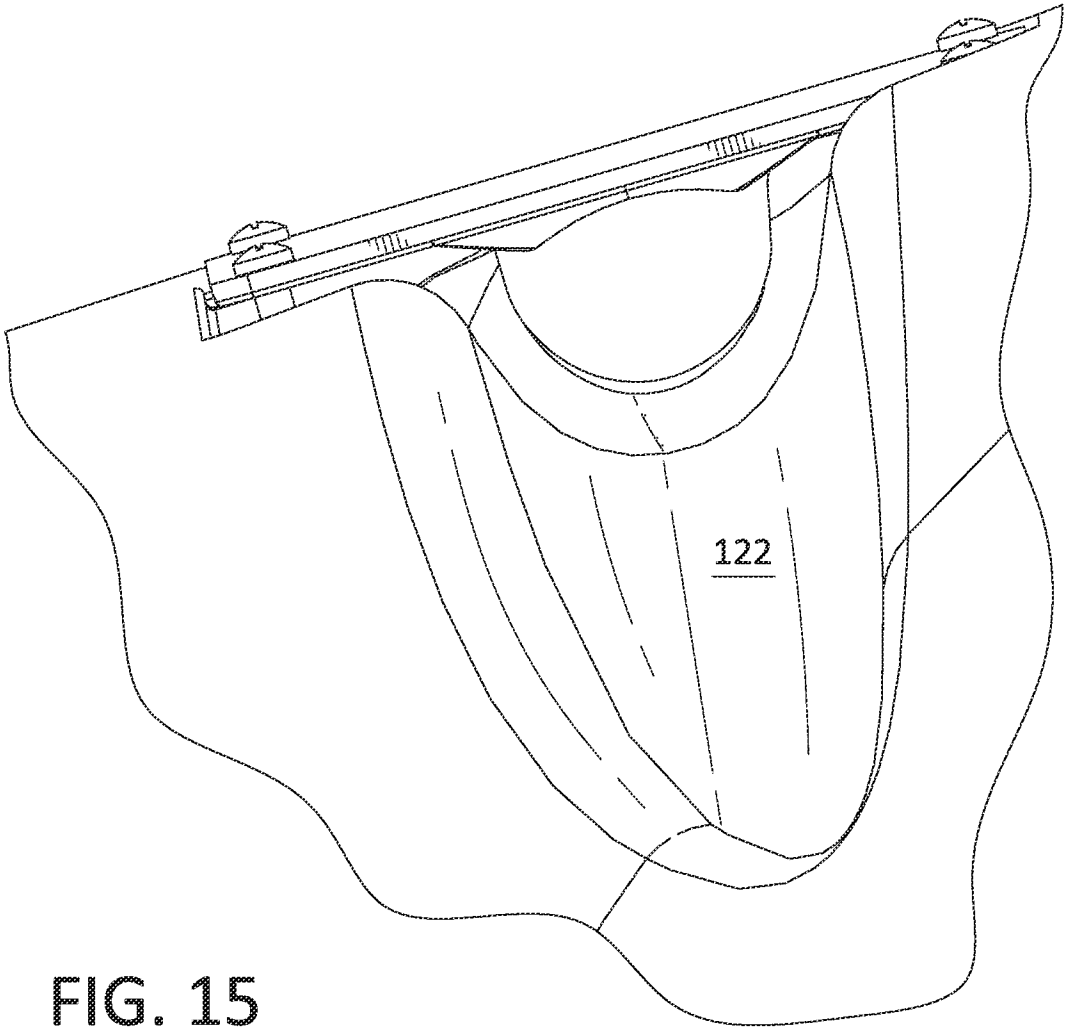
FIG. 15 is a detail view of an arrangement of a recess and a venturi plate, according to some example embodiments.
Figure 16:
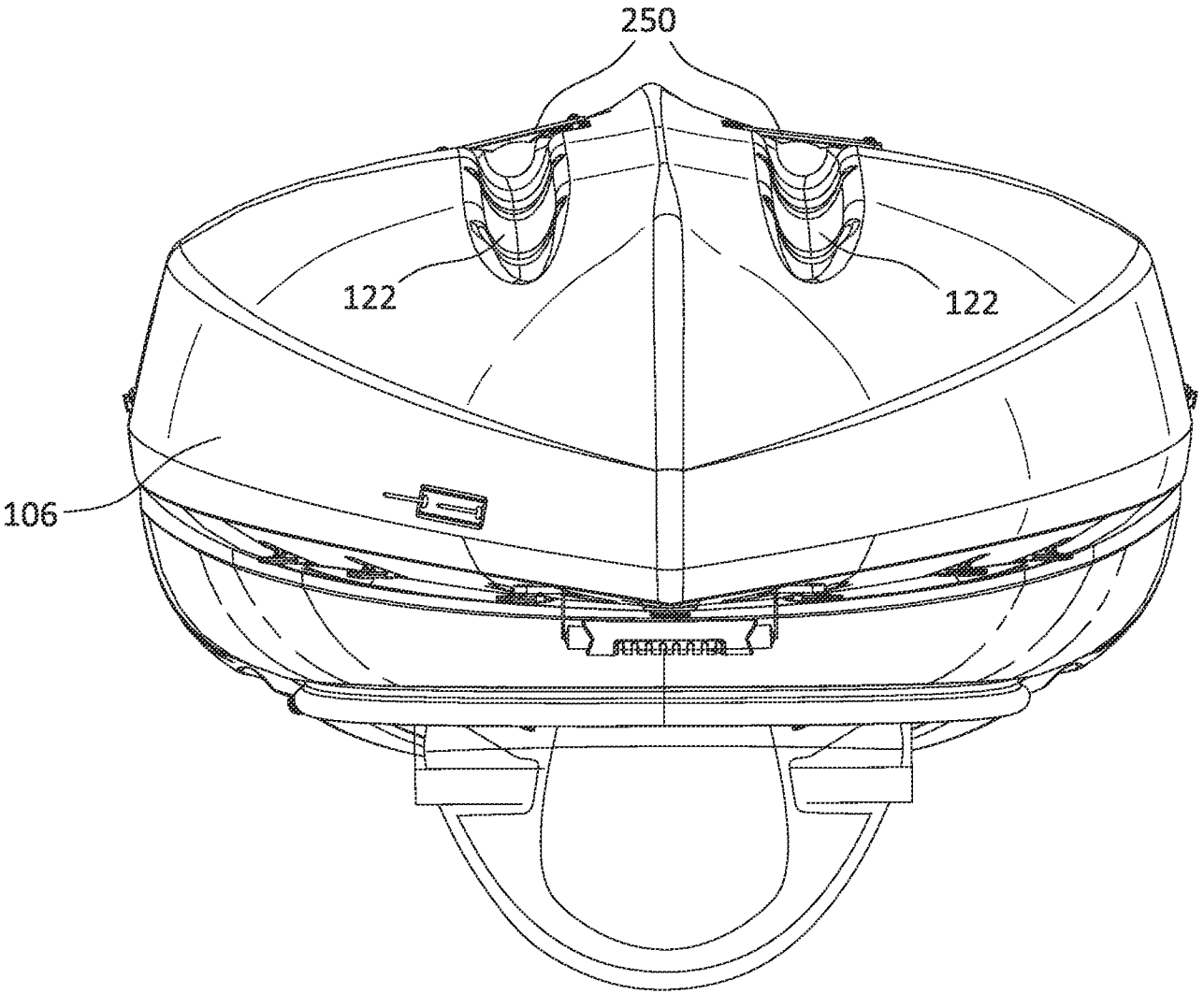
FIG. 16 is a front view of an example arrangement of multiple recesses and corresponding venturi plates, according to some example embodiments.
Figure 17:
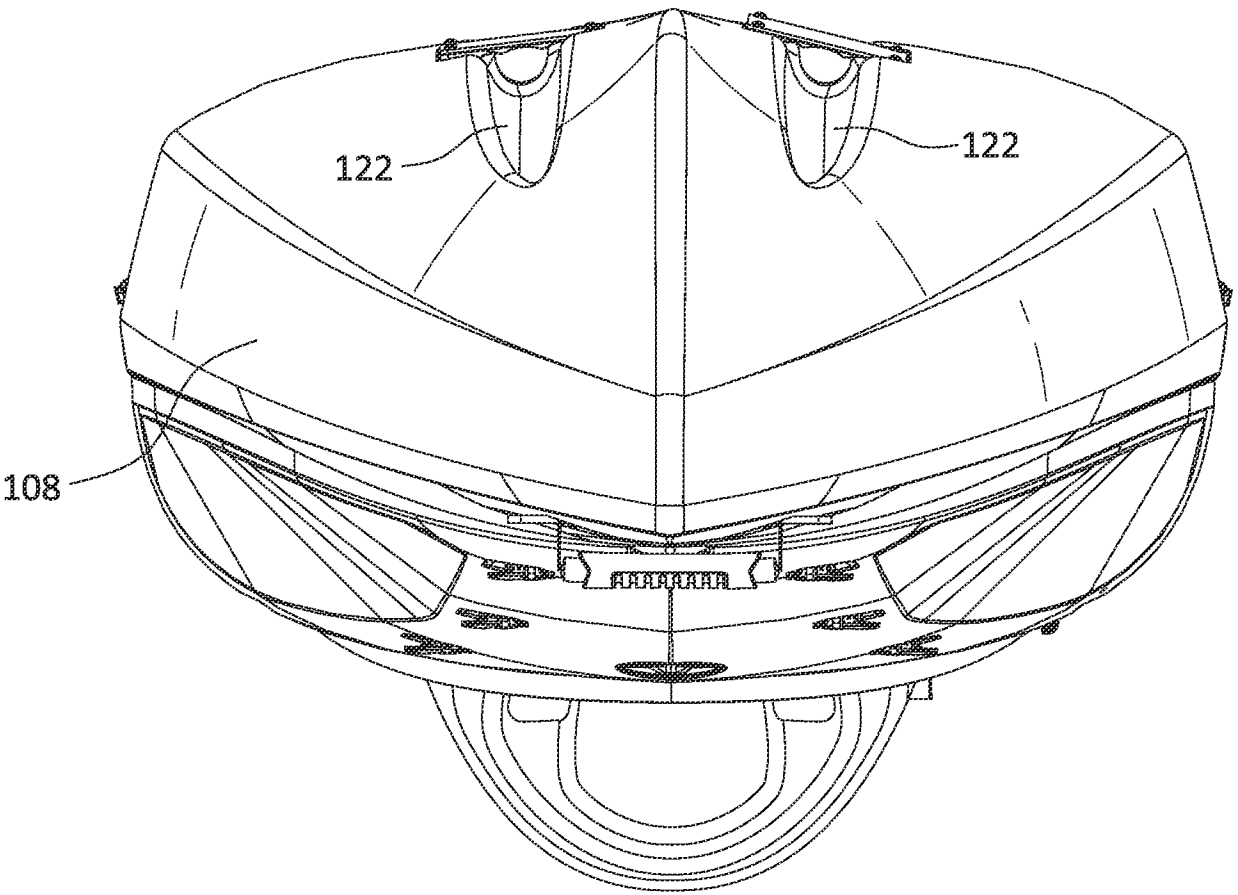
FIG. 17 is another front view of an example arrangement of multiple recesses and corresponding venturi plates, according to some example embodiments.
Figure 18A:
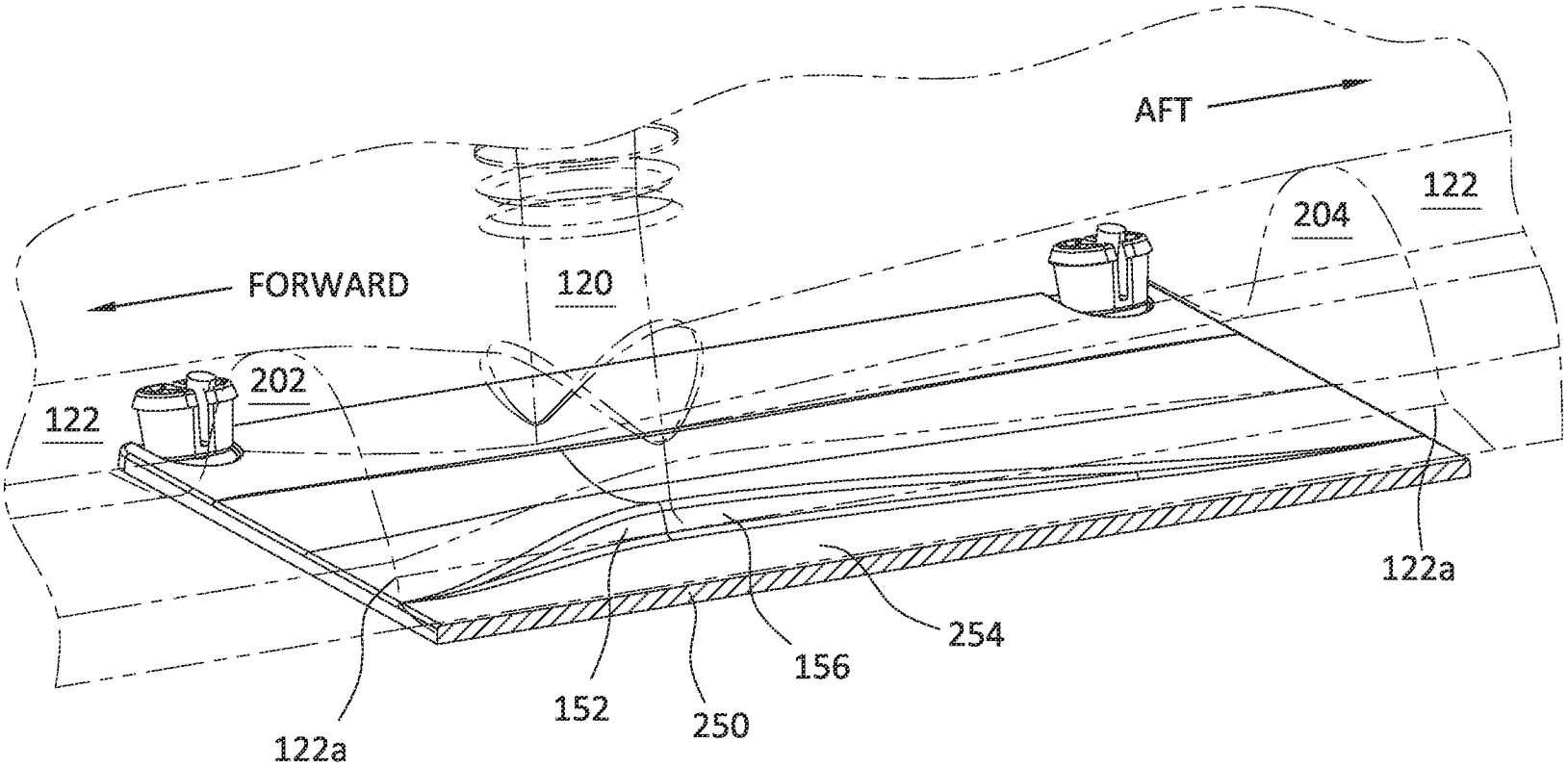
FIG. 18*a* is a front perspective view (some portions removed/transparent for clarity) showing aspects of an interface of a scupper with a venturi, according to some example embodiments.
Figure 18B:
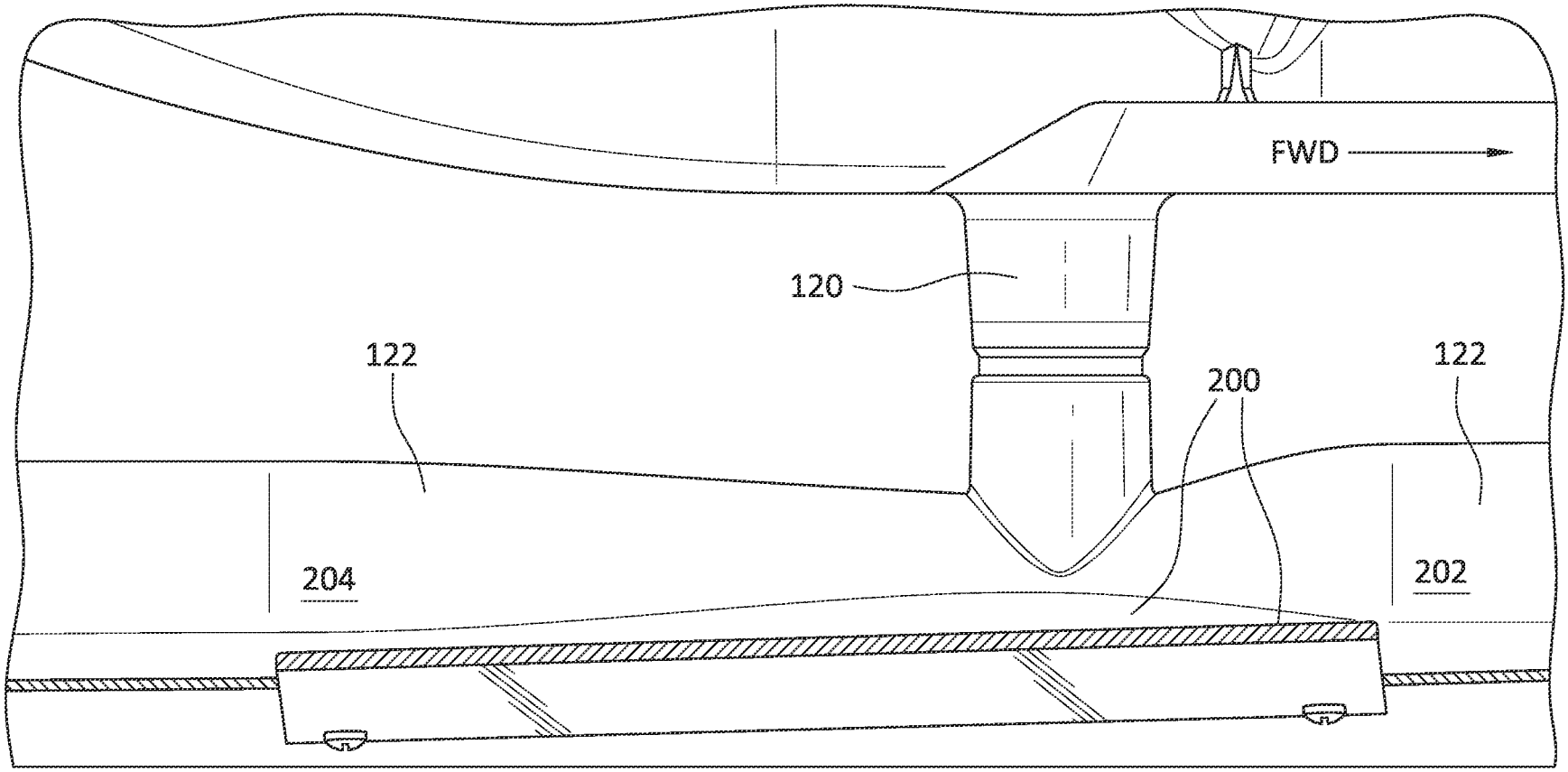
FIG. 18*b* is a side perspective view showing aspects of an interface of a scupper with a venturi, according to some example embodiments.
Figure 19:
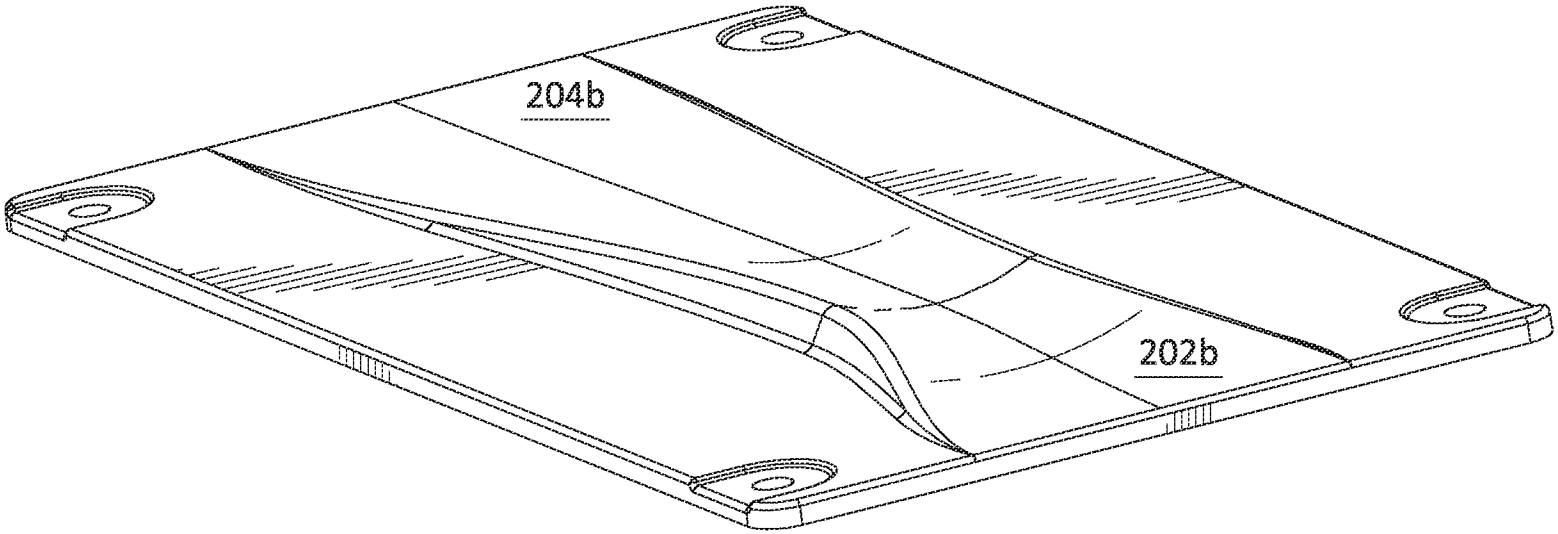
FIG. 19 is a front perspective view of a venturi plate, according to some example embodiments.
Figure 20:
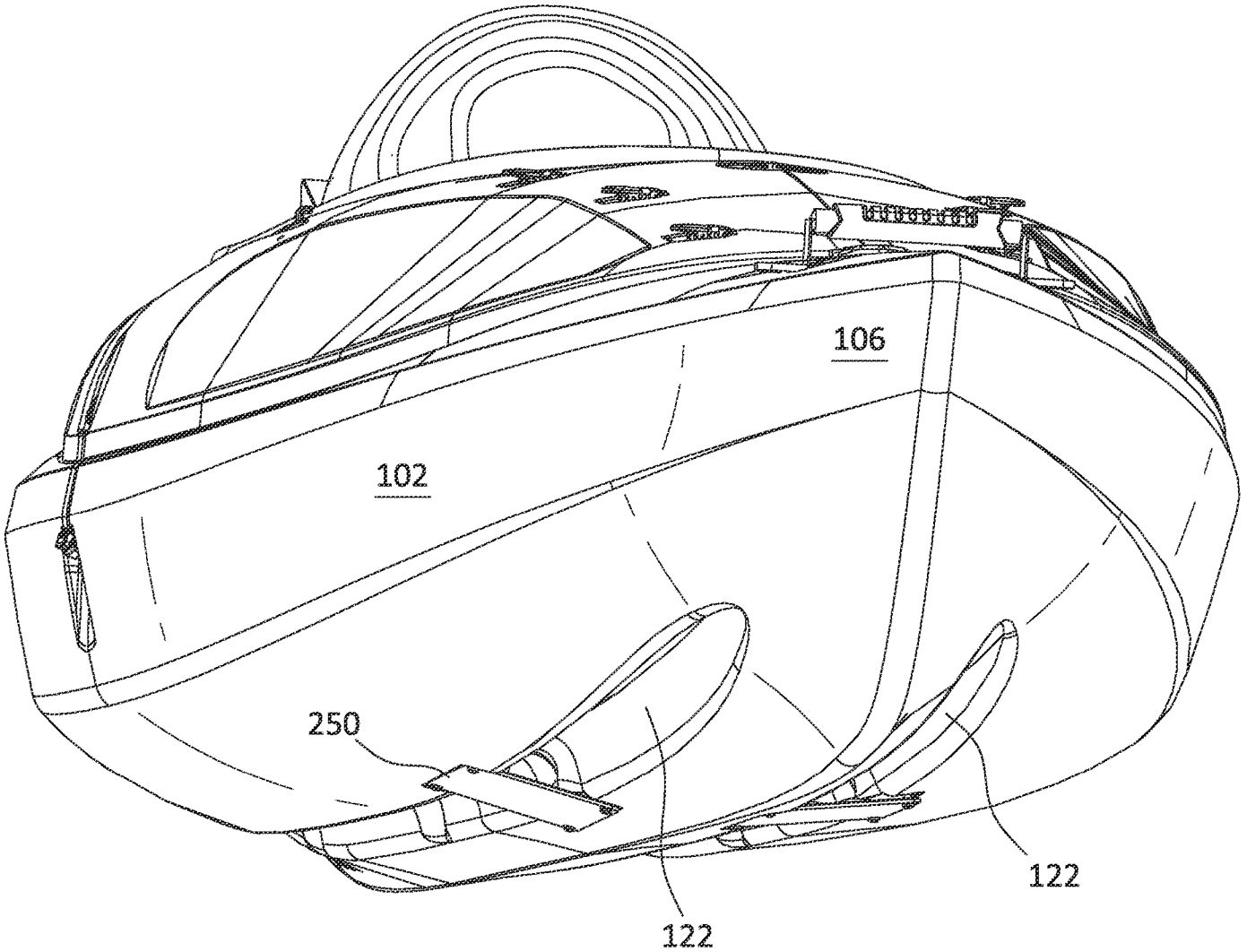
FIG. 20 is a front perspective view of a recess defined in a hull and an interface of the recess with a venturi plate, according to some embodiments.

When thus aligned, the venturi inlet portions 202*a* and 202*b* may be mechanically, and releasably, connectable/connected to each other such as with releasable push tabs or other mechanisms, may contact each other without being mechanically connected, or may be spaced apart from each other by a small distance. As shown in FIGS. 13 and 18*a*, some embodiments may be configured such that part or all of the venturi inlet portion 202*a* is positioned about the venturi inlet portion 202*b* so that, for example, an edge 122*a* of the recess 122 may be in close proximity with, or contact, the base 254 of the venturi plate 250. Put another way, part, or all, of the venturi inlet portion 202*b* of the venturi plate 250 may be positioned within the venturi inlet portion 202*a* defined by the recess 122. All of these same considerations regarding the arrangement of venturi inlet portions 202*a* and 202*b* apply as well to the venturi outlet portions 204*a* and 204*b*.

As shown in the Figures, the venturi inlet portion 202*b* of the venturi plate 250 may be defined by a pair of walls 252 that rise gradually up from a base 254 of the venturi plate 250. As the walls 252 rise, they may also move inward with reference to a longitudinal axis V of the venturi plate 250. Thus, the distance between the opposing walls 252 may gradually decrease. In some embodiments, the walls 252 may reach their maximum height, and closest distance to each other, at a point, or in a throat area 253, that includes a throat T 253*a* of the venturi 200. In general, the throat T 253*a* refers to the point or area of minimum diameter of the venturi 200. In at least some embodiments, an outlet of the scupper 120 connects to the venturi 200 at, or near, the throat T 253*a*, as shown in the example of FIG. 13. The throat T 253*a* may lie entirely in a plane that is generally perpendicular to the longitudinal axis V of the venturi, and from which the walls 252 (and 256, see below) extend, or the throat T 253*a* may have a particular length, such as in the example of FIG. 1. No particular throat configuration is necessarily required however.

In addition to the walls 252, the venturi plate 250 may further comprise a pair of walls 256 that descend gradually from the throat T area to the base 254 of the venturi plate 250. As the walls 256 descend, they may also move outward with reference to a longitudinal axis V of the venturi plate 250. Thus, the distance between the opposing walls 256 may gradually increase. In some embodiments, the walls 256 may be at their maximum height, and closest distance to each other, at a point, or in an area, that corresponds to the throat T of the venturi 200. As shown in the example of FIG. 10, the walls 252 and/or the walls 256 may diminish to the point that they simply blend into the base 254 and disappear.

With particular reference now to FIGS. 12, 15, 16, 17, 18*a*, and 18*b*, it can be seen that the configuration of the recess 122 may be such that its diameter varies from one location to another along the recess 122, particularly in the area between the inlet portion 202*a* and the outlet portion 204*a*. One example of this is indicated by the arrows on the left hand side of FIG. 12, where each arrow indicates a recess 122 portion of a different respective diameter. On the right hand side of FIG. 12, it can be seen how the venturi plate 250 cooperates with the recess 122 to define the venturi 200.

In one alternative embodiment, a flat venturi plate may provided that, in contrast with the venturi plate 250, does not include any walls or other projections from its surfaces. The flat venturi plate may be generally flat on one or both sides and may be configured to be removably attached to a hull of a watercraft, such as in the way that the venturi plate 250 may be attachable to the hull 102. In this alternative embodiment, the venturi would be defined by the flat venturi plate in combination with a recess having a configuration similar or identical to the configuration of recess 122. A flat venturi plate may not function as effectively as the venturi plate 250 but may be relatively easier and less expensive to manufacture.

B.3 Aspects of Venturi Operation

With continued reference to the Figures, and FIG. 1 in particular, further details are provided concerning the operation of a venturi, such as the example venturis disclosed herein. In general, and as noted elsewhere herein, example embodiments include a venturi geometry built into a blow molded hull under each scupper drain hole and an injection molded venturi plate. Due to the nature of the venturi configuration, the velocity of the water entering the venturi increases as the water passes through the throat of the venturi. This increase in velocity reduces the water pressure in the throat area to a pressure that is lower than the water pressure in the scupper, such that a pressure differential is created. As a result of this pressure differential, the relatively high pressure water in the scupper flows out of the scupper into the relatively low water pressure area in the throat portion of the venturi, and then out the venturi outlet. This flow of water through the venturi may be achieved simply by moving the watercraft through the water. No particular speed is needed for the watercraft movement to drain the venturi, but a relatively higher speed may drain the scupper faster than a relatively lower speed.

In more detail, and with continued reference to FIG. 1, the Bernoulli equation (below) can be used to determine, in a venturi for example, the velocity or fluid pressure at any point in the venturi.

$$\frac{v^2}{2g} + z + \frac{p}{\rho g} = \text{constant}$$

In this equation, v is fluid velocity at a point, g is acceleration due to gravity, z is the elevation of the point above a reference plane, p is the fluid pressure at the point, and ρ is the fluid density at all points in the fluid. Note that this equation assumes steady, incompressible flow, and that friction due to viscous forces is negligible. Further, given that Q=v*A (where Q is the mass flow rate, v is fluid velocity, and A is the area through which the fluid passes), it can be seen that v=Q/A. Thus, assuming that Q is constant, v will increase when A decreases. Specifically, the constriction embodied by the throat in the venturi will cause the velocity of the fluid passing through the venturi to increase. The change (decrease) in pressure attributable to this change (increase) in fluid velocity can be determined using the Bernoulli equation.

C. FURTHER EXAMPLE EMBODIMENTS

Following are some further example embodiments of the invention. These are presented only by way of example and are not intended to limit the scope of the invention in any way.

Embodiment 1. A watercraft, comprising: a hull that defines a cockpit; a scupper that extends from the cockpit through an exterior surface of the hull; and a venturi tube that is in fluid communication with the scupper.

Embodiment 2. The watercraft as recited in embodiment 1, wherein, when the portable watercraft is in use, fluid flows through the venturi tube, and the flow of fluid through the venturi tube drains the scupper.

Embodiment 3. The watercraft as recited in any of embodiments 1-2, wherein a portion of the venturi tube is integral with the hull.

Embodiment 4. The watercraft as recited in any of embodiments 1-2, wherein the venturi tube comprises multiple parts that are selectively attachable together.

Embodiment 5. The watercraft as recited in any of embodiments 1-2 and 4, wherein the venturi tube comprises a first portion defined in, and integral with, the hull, and a second portion that is removably attachable to the hull.

Embodiment 6. The watercraft as recited in any of embodiments 1-2 and 4-5, wherein the venturi tube comprises a first portion defined in, and integral with, a recess formed in the hull, and a second portion comprising a venturi plate that is removably attachable to the hull.

Embodiment 7. The watercraft as recited in any of embodiments 1-6, wherein an outlet of the scupper communicates with a throat area of the venturi tube.

Embodiment 8. The watercraft as recited in any of embodiments 1-7, wherein the venturi tube has no moving parts.

Embodiment 9. The watercraft as recited in any of embodiments 1-8, wherein the scupper and venturi tube are valveless.

Embodiment 10. The watercraft as recited in any of embodiments 1-9, wherein the watercraft comprises an integral, single piece, hollow plastic structure made by any of the following processes: blow molding; injection molding; stretch blow molding; rotomolding; or, twin sheet molding.

Embodiment 11. A venturi plate, comprising: a body defining a base; a first set of walls integral with the based and partly defining a venturi inlet; and a second set of walls integral with the base and partly defining a venturi outlet.

Embodiment 12. The venturi plate as recited in embodiment 11, wherein the venturi plate is configured to reside flush in a recess defined in a hull of a watercraft.

Embodiment 13. The venturi plate as recited in any of embodiments 11-12, wherein the venturi plate is configured to cooperate with complementary structure of a watercraft to define a venturi tube when the venturi plate is attached to a hull of the watercraft.

Embodiment 14. The venturi plate as recited in any of embodiments 11-13, wherein the first set of walls is integral with the second set of walls.

Embodiment 15. The venturi plate as recited in any of embodiments 11-14, wherein the first set of walls and the second set of walls collectively define part of a throat area of a venturi tube.

Embodiment 16. A watercraft comprising: a hull that defines a cockpit; a scupper that extends from the cockpit through an exterior surface of the hull; and a recess defined by the hull and in communication with the scupper, and the recess defines a portion of a venturi tube.

Embodiment 17. The watercraft as recited in claim 16, wherein the portion of the venturi tube comprises an inlet portion, a throat portion, and an outlet portion.

Embodiment 18. The watercraft as recited in any of embodiments 16-17, wherein the inlet portion of the venturi tube is arranged forward of the outlet portion of the venturi tube so that as the watercraft moves forward through water, the water flows first into the inlet portion of the venturi tube, through the throat portion, and the out of the outlet portion of the venturi tube.

Embodiment 19. The watercraft as recited in any of embodiments 16-18, wherein the recess is oriented generally longitudinally along the hull.

Embodiment 20. The watercraft as recited in any of embodiments 16-19, wherein the recess is configured such that when a complementary structure is attached to the hull, the complementary structure and the recess together define an entire venturi tube.

D. FURTHER DISCUSSION

As apparent from this disclosure, example embodiments of the invention may possess various useful and advantageous features and aspects. For example, some conventional approaches to implementing scupper drain functionality employ a ball check valve, or similar, as part of a scupper insert. However, this approach is problematic because the scupper insert may have to be properly oriented and positioned in the hull in order to function properly. Moreover, the scupper insert may not function properly, or at all, if the ball check valve becomes damaged or clogged. Further, any mechanical device with moving parts will require maintenance, repair, and/or replacement at some point. As well, to the extent any part of a conventional scupper insert extends above the bottom surface of the cockpit, that scupper insert may be exposed to damage and wear.

In contrast with conventional approaches to scupper drainage, such as those examples noted above, embodiments of the invention may comprise a scupper drain system that has no moving parts, and may not require the use of scupper plugs. One or more embodiments of the invention may be 'valveless' in that they do not include or require a check valve, or other valve, of any kind. As such, example embodiments may require little, or no, maintenance and repair. Further, example embodiments do not require any sort of alignment, or other procedures, to be performed in order to ensure that the drainage system is properly configured to function. Rather, as long as the venturi plate is secured in position, nothing further is required of the user except to move the watercraft forward to implement the venturi effect and so drain the scupper. In that regard, no particular watercraft speed is required for the user to be able to drain the scupper. In fact, the scupper may simply be drained during normal forward motion of the watercraft. Further, due to the physical configuration of some example embodiments of venturi plates, which may be generally trapezoidal for example, it may be impossible to incorrectly install the venturi plate in the hull of the watercraft, should there ever be a reason to remove and reinstall the venturi plate or to install a new venturi plate. Another useful aspect of some embodiments is that due to the effectiveness of the scupper draining provided by the venturi, embodiments of the invention may enable the watercraft to be produced with relatively lower footwells to accommodate a lower body position within the cockpit. Finally, while conventional approaches to scupper drainage, such as the use of a scupper insert that includes a ball check valve, may realize some de minimis venturi effect as the watercraft moves through the water, such conventional approaches differ materially from the disclosed embodiments in that, in contrast with the conventional approaches, the disclosed embodiments include a made-for-the-purpose venturi as part of a scupper drainage system. The conventional scupper drainage systems noted above and used in portable watercraft do not include a venturi tube such as is employed in example embodiments of the invention. Further, such conventional scupper drainage systems and the watercraft with which they are employed would require significant modifications if a venturi tube were to be used, instead, for draining a scupper.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A watercraft comprising:

a hull that defines a cockpit;

a scupper that extends from the cockpit through an exterior surface of the hull; and a venturi tube that is in fluid communication with the scupper, and the venturi tube comprises an inlet portion, an outlet portion, and a throat area positioned between the inlet portion and the outlet portion, and the inlet portion is located forward of the throat area, and the outlet portion is located aft of the throat area.

2. The watercraft as recited in claim 1, wherein, when the watercraft is in use, a flow of fluid through the venturi tube drains the scupper.

3. The watercraft as recited in claim 1, wherein a portion of the venturi tube is integral with the hull.

4. The watercraft as recited in claim 1, wherein the venturi tube comprises multiple parts that are selectively attachable together.

5. The watercraft as recited in claim 1, wherein the venturi tube comprises a first portion defined in, and integral with, the hull, and a second portion that is removably attachable to the hull.

6. The watercraft as recited in claim 1, wherein the venturi tube comprises a first portion defined in, and integral with, a recess formed in the hull, and a second portion comprising a venturi plate that is removably attachable to the hull.

7. The watercraft as recited in claim 1, wherein an outlet of the scupper connects to the throat area of the venturi tube.

8. The watercraft as recited in claim 1, wherein the venturi tube has no moving parts.

9. The watercraft as recited in claim 1, wherein the scupper and venturi tube are valveless.

10. The watercraft as recited in claim 1, wherein the watercraft comprises an integral, single piece, hollow plastic structure made by any of the following processes: blow molding; injection molding; stretch blow molding; roto-molding; or, twin sheet molding.

11. A watercraft, comprising:

a hull that defines a cockpit;

a scupper that extends from the cockpit through an exterior surface of the hull; and a venturi tube that is in fluid communication with the scupper, wherein the venturi tube comprises a first portion defined in, and integral with, the hull, and a second portion that is removably attachable to the hull and, wherein the second portion of the venturi tube comprises a venturi plate that comprises:

a body defining a base;

a first set of walls integral with the base and partly defining a venturi inlet of the venturi tube; and a second set of walls integral with the base and partly defining a venturi outlet of the venturi tube.

12. The watercraft as recited in claim 11, wherein the venturi plate is configured to reside flush in a recess defined in the hull of the watercraft.

13. The watercraft as recited in claim 11, wherein the venturi plate is configured to cooperate with the hull of the watercraft to define the venturi tube when the venturi plate is attached to the hull of the watercraft.

14. The watercraft as recited in claim 11, wherein the first set of walls is integral with the second set of walls.

15. The watercraft as recited in claim 11, wherein the first set of walls and the second set of walls collectively define part of a throat area of the venturi tube.

16. A watercraft comprising:

a hull that defines a cockpit;

a scupper that extends from the cockpit through an exterior surface of the hull; and a recess defined by the hull and in communication with the scupper, and the recess defines an upper portion of a venturi tube, and the upper portion of the venturi tube is integral with the hull and the upper portion of the venturi tube comprises: an upper portion of an inlet of the venturi tube; an upper portion of a throat of the venturi tube; and, an upper portion of an outlet of the venturi tube, and the upper portion of the inlet of the venturi tube, the upper portion of the throat of the venturi tube, and the upper portion of the outlet of the venturi tube, are all arranged for fluid communication with each other.

17. The watercraft as recited in claim 16, wherein the upper portion of the inlet of the venturi tube is arranged forward of the upper portion of the outlet of the venturi tube so that as the watercraft moves forward through water, the water flows first into the upper portion of the inlet of the venturi tube, then through the upper portion of the throat area of the venturi tube, and finally out of the upper portion of the outlet of the venturi tube.

18. The watercraft as recited in claim 16, wherein the recess is oriented generally longitudinally along the hull.

19. The watercraft as recited in claim 16, wherein the recess is configured such that when a venturi plate is attached to the hull, the venturi plate and the recess together define an entire venturi tube.

20. The watercraft as recited in claim 16, wherein the hull is configured to mate with a venturi plate that defines a lower portion of the venturi tube.

* * * * *